US007547409B2

(12) United States Patent
Aubrey

(10) Patent No.: US 7,547,409 B2
(45) Date of Patent: Jun. 16, 2009

(54) COMPACT MICRO-POROUS MEDIA DEGASSER

(75) Inventor: Leonard S. Aubrey, Arden, NC (US)

(73) Assignee: Poevair PLC, Norfolk (GB)

( * ) Notice: Subject to any disclaimer, the term of this patent is extended or adjusted under 35 U.S.C. 154(b) by 461 days.

(21) Appl. No.: 10/559,898

(22) PCT Filed: Jun. 10, 2004

(86) PCT No.: PCT/US2004/018594

§ 371 (c)(1),
(2), (4) Date: Dec. 6, 2005

(87) PCT Pub. No.: WO2004/111281

PCT Pub. Date: Dec. 23, 2004

(65) Prior Publication Data

US 2006/0125160 A1 Jun. 15, 2006

(51) Int. Cl.
*C22B 21/00* (2006.01)

(52) U.S. Cl. ..... 266/220; 266/217

(58) Field of Classification Search ..... 266/220, 266/217

See application file for complete search history.

(56) References Cited

U.S. PATENT DOCUMENTS

| | | | | |
|---|---|---|---|---|
| 3,743,500 | A | 7/1973 | Foulard et al. | |
| 3,881,709 | A | 5/1975 | Steen | |
| 4,007,923 | A | 2/1977 | Chia | 266/217 |
| 4,179,103 | A * | 12/1979 | Bentz et al. | 266/220 |
| 4,735,400 | A | 4/1988 | Miyamaoto et al. | |
| 4,844,425 | A * | 7/1989 | Piras et al. | 266/220 |
| 5,733,500 | A | 3/1998 | Meseha | |

FOREIGN PATENT DOCUMENTS

| | | |
|---|---|---|
| GB | 2077890 | 12/1981 |
| WO | WO/2004/111281 A3 | 12/2004 |

OTHER PUBLICATIONS

Patent Abstracts of Japan, vol. 010, No. 219 (C-363), Jul. 31, 1986 and JP 61056257.

International Search Report, PCT/US2004/018594, Jan. 18, 2005, Bombeke.

* cited by examiner

*Primary Examiner*—Scott Kastler
(74) *Attorney, Agent, or Firm*—Joseph T. Guy; Nexsen Pruet, LLC

(57) ABSTRACT

A degasser (10) for molten metal with a microporous plate (11). The microporous has at least one internal passageway (13) and an interface tube (12) attached to the microporous plate in flow communication with the internal passageway.

28 Claims, 9 Drawing Sheets

COMPACT MICRO-POROUS MEDIA DEGASSER

BACKGROUND OF THE INVENTION

The present invention is related to purification of molten metal. More particularly, the present invention is directed to the removal of hydrogen gas and insoluble impurities from molten aluminum.

Hydrogen is the only gas with significant solubility in molten aluminum. The solubility of hydrogen in molten aluminum is illustrated in FIG. 1. As the temperature of molten metal decreases to the solidification temperature the solubility of hydrogen drops significantly. This significant drop results in the formation of undesirable micro-shrinkage and porosity in the final solidification structure. As indicated in FIG. 1, about 5% of the hydrogen in the molten aluminum remains after completion of the solidification. The remaining 95% is rejected into the liquid until the concentration reaches the point where a hydrogen gas bubble is formed.

Contact of molten aluminum with ambient water moisture is nearly unavoidable under reasonable manufacturing conditions. Unfortunately, molten aluminum is highly reactive and can easily reduce, or decompose, any water present by the reaction:

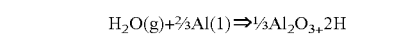

$$H_2O(g)+\tfrac{2}{3}Al(1)\Rightarrow\tfrac{1}{3}Al_2O_{3+}2H$$

The removal of hydrogen down to an acceptable level prior to solidification is required to obtain a metallurgically sound ingot or casting. The industry accepted practice to remove or lower the dissolved hydrogen content is to bubble an inert or semi-inert purging gas directly through the molten aluminum prior to casting and solidification. The technology related to purging molten aluminum with inert gas is exemplified in U.S. Pat. No. 5,340,379.

Hydrogen dissolved in molten aluminum exhibits a high vapor pressure relative to common alloying constituents and impurities. Therefore, hydrogen can be preferentially removed by purging with inert gas or by vacuum treatment. Hydrogen dissolved in molten metal is removed by the recombination of molecular hydrogen to form hydrogen gas based on the following reaction:

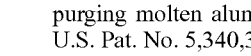

$$H=\tfrac{1}{2}H_2(gas)$$

The chemical equilibrium ($K_{H_2}$) of the reaction is a function of the partial pressure (ρ) given by:

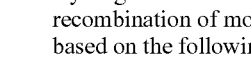

$$K_{H_2}=\rho H_2^{1/2}$$

For pure molten aluminum $K_{H_2}$ is given by:

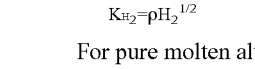

$$Ln\,(K_H)=5869/T+3.282$$

There are several ways to directly introduce purging gas into molten aluminum to reduce the hydrogen content. A common method includes the use of a simple pipe or lance, a porous plug, a spinning nozzle degasser or a high-pressure nozzle injection. Exemplary references include U.S. Pat. Nos. 5,340,379; 5,660,614; 6,056,803 and references cited therein.

The rate of removal, and the final hydrogen value obtained, is dependent on several parameters such as the metal temperature, thermodynamic solubility, purging gas flow rate, metal flow rate in the case of continuous degassing, furnace size in the case of static degassing, gas removal ratio and bubble size or surface area. For a given purge gas flow rate the hydrogen removal rate is controlled by the bubble size. The finer the bubble size the higher the rate of diffusion and therefore the higher the rate of removal. A simple lance or tube produces a very large bubble size and therefore results in a relatively slow removal rate. The removal rate is improved by introducing the gas through a porous plug or by a spinning rotor that shears the gas stream into fine bubbles. The finer bubble size results in increased contact surface area with an increased transfer rate and slower bubble ascent rate based on the smaller Stoke's diameter.

There are several limitations in using inert gas bubbles to remove hydrogen from molten aluminum. Efficient removal requires the gas bubbles to be relatively small in order to maximize contact surface area. The smallest gas bubbles are typically obtained with a rotary impeller degasser. The degassers are capable of producing very fine bubbles that can remain suspended for a long period of time. As a result rotary impeller degassers are normally installed a relatively far distance from the casting machine in order to allow sufficient time for gas bubbles to separate by flotation. This distance also allows ample time for re-absorption of hydrogen back into the molten aluminum from atmospheric moisture as well as moisture containing refractory contact materials. The lowest achievable hydrogen content is temperature dependent based on hydrogen solubility-temperature equilibrium. The lower the temperature at which the hydrogen removal process is conducted, the lower the final hydrogen content at solidification. Ideally, hydrogen removal should be made just prior to the onset of solidification, which is not compatible with gas purging.

While rotary impeller degassers are sufficient for generating fine bubbles other problems are created by their use. It is known that filtration, utilizing either a deep bed or ceramic foam filter, is required in addition to degassing. These combined systems typically utilize a significant amount of floor space and require that the molten metal be held between casts in one, or both, treatment units. Holding molten metal creates specific problems. First, an external heat source must be employed to maintain the temperature of the molten metal between casts. This requires an elaborate heating system which is a significant capital expense and has an attendant energy consumption which is expensive and variable. Secondly, the treatment unit must be drained and refilled to change the alloy composition. Draining and refilling is a significant drain on resources requiring non-production labor cost, conversion cost, and productivity losses due to the equipment downtime required for the transition. A compact degasser has been described in P. D. Waite, "Improved Metallurgical Understanding Of The Alcan Compact Degasser After Two Years Of Industrial Implementation In Aluminum Casting Plates", *Conference Proceedings at the* 127$^{th}$ *TMS/AIME Annual Meeting,* San Antonio, February 1998, pages 791-796. This system, while fully drainable, is not compact by current standards. The system also requires substantial ancillary support equipment for the launder including a degassing hood, baffle plates, drive modules including rotors, lifting mechanism, fume exhaust system, PLC panel and interface/gas mixing panel.

A particular problem with the prior art methods of degassing aluminum is the difficulty associated with monitoring the efficiency of the degassing operation. It is well known that a system which can not be effectively monitored can not be optimized for performance.

Summarily, the art has been lacking a suitable degassing and filtering system and apparatus.

SUMMARY OF THE INVENTION

It is an object of the present invention to provide an improved apparatus, and method, for degassing molten metal, preferably aluminum.

It is another object of the present invention to provide an apparatus, and method, for degassing molten metal, preferably aluminum, which is efficient and which requires a lower investment with regards to equipment and space than previous methods.

It is another object of the present invention to provide an apparatus, and method, for degassing aluminum whereby the efficiency of the degassing operation can be monitored for efficiency and optimized for performance.

A particular feature of the present invention is the ability to incorporate the invention in existing environments with minimal alterations.

Another particular feature of the present invention is the ability to incorporate the invention into new installations thereby greatly enhancing the efficiency of the casting operation.

These and other advantages, as will be realized from the description herein, are provided in a degasser, 10, for molten metal with a microporous plate, 11. The microporous plate has at least one internal passageway, 13, and an interface tube, 12, attached to the microporous plate in flow communication with the internal passageway.

Yet another embodiment is provided in a method for purifying molten metal. The method includes melting metal to form molten metal. The molten metal is passed through a containment vessel wherein the containment vessel has a degasser and the degasser has a microporous plate with at least one internal passageway and an interface tube attached to the microporous plate and in flow communication with the internal passageway. Hydrogen is removed from the microporous plate through the interface tube.

A particularly preferred embodiment is provided in apparatus for purifying molten metal. The apparatus has a containment vessel with an inlet throat and an outlet throat. A degasser is between the inlet throat and the outlet throat. The degasser has a microporous plate with at least one internal passageway and an interface tube attached to the microporous plate in flow communication with the internal passageway.

DETAILED DESCRIPTION OF THE INVENTION

The present invention is specific to an apparatus, and method, for degassing aluminum which is compact, efficient, and which can be monitored for optimization. In general, the present invention utilizes a micro-porous plate, or panel, which is immersed in the molten metal and which removes hydrogen by diffusion into the plate for removal by purge or vacuum. The invention will be described with reference to the various drawings which form an integral part of the present invention. The drawings are illustrative and not intended to limit the invention. In the various drawings similar elements will be numbered accordingly.

Figure 1:
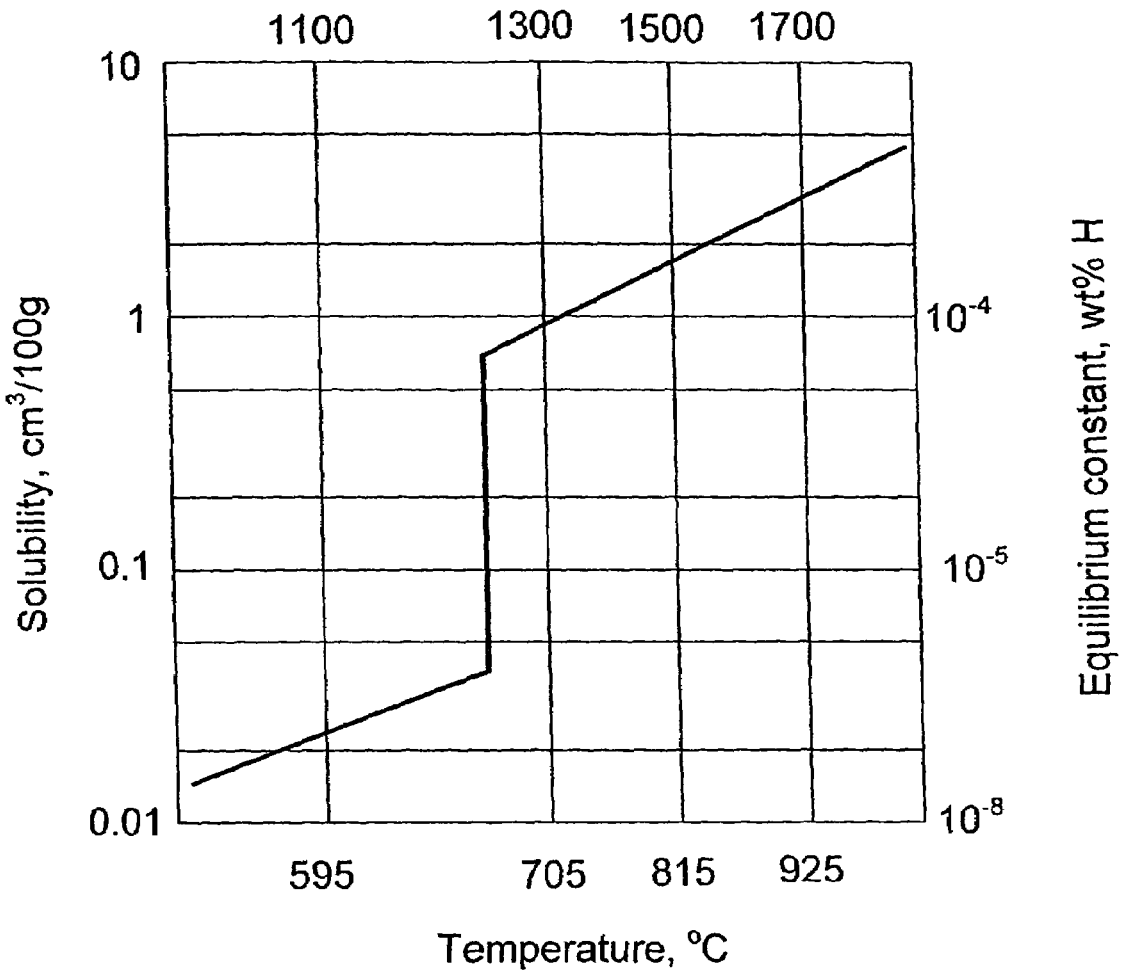
FIG. 1 is a chart depicting solubility of hydrogen in aluminum.
Figure 2:
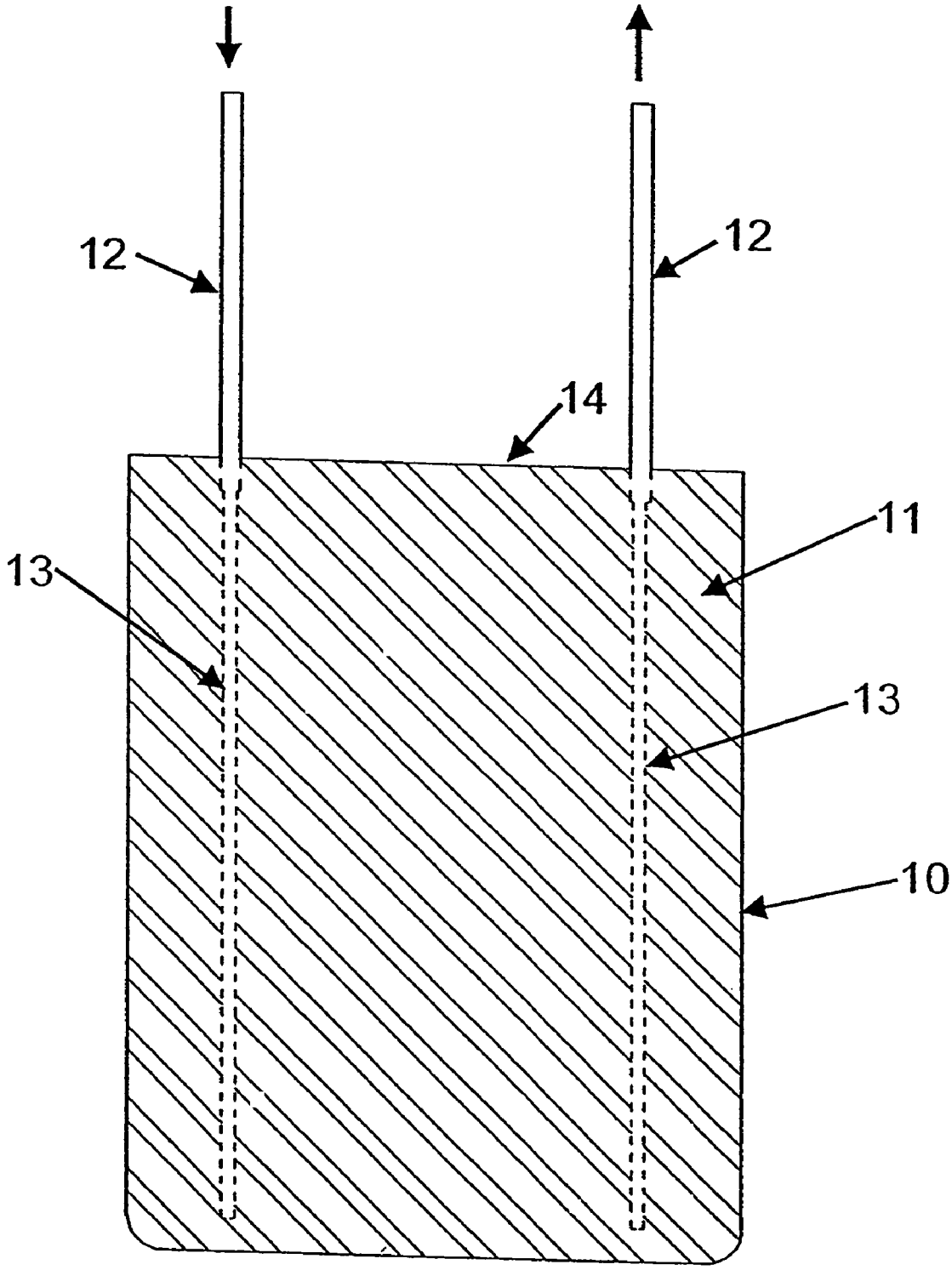
FIG. 2 is a cross-sectional view of a degasser plate of the present invention.

The porous media degasser comprises a micro-porous plate, or panel, that is submerged into the molten metal such as aluminum, steel, copper or iron, to be degassed. An embodiment of the present invention is illustrated in FIG. 2, wherein the degasser, generally represented at 10, is shown in cross-sectional view. The degasser, 10, comprises a microporous plate, 11, with at least one interface tube, 12, interfaced to internal passageways, 13. The upper extent of the plate, 11, comprises a seal, 14. The interface tube, 12, removes hydrogen gas by vacuum or by purging. In a vacuum arrangement the interface tube, 12, is attached to a vacuum which causes a decreased pressure in the plate. Any gases contained therein are removed. With a vacuum arrangement a single interface tube, and passageway, can be employed but multiple interface tubes and passageways are preferred. In a purge arrangement a non-reactive purging gas, preferably argon or nitrogen, is introduced to one interface tube and exhausted from the other interface tube. The exhaust can be with vacuum assist if desired.

The interface tubes are non-porous, preferably metal or dense ceramic such as graphite, boron nitride, alumina, zirconia or mullite. Preferably, the interface tubes could be constructed of steel or austenitic stainless steel. The tubes can be coated, to prevent dissolution, with a material such as plasma coated alumina or zirconia or the tubes could be coated with a material such as boron nitride.

While not limited to any theory, the function of the interface tubes and associated internal passageways is to provide a continuous flow of purging gas. The flowing purging gas continuously removes hydrogen gas which is formed by hydrogen atoms diffusing into the porous plate and reacting therein to form hydrogen gas. By continuously removing the hydrogen gas a high driving force is maintained for the diffusion of hydrogen atoms, or cations, into the plate. Either a purge or a vacuum removes the hydrogen by the same basic mechanism based on the partial pressure of hydrogen in the plate relative to the molten metal.

The presence of hydrogen in argon has a significant impact on the thermal conductivity. This change in thermal conductivity can be measured and quantified using commercial thermal conductivity analyzers. By measuring the purging gas flow rate and the % hydrogen gas in the argon, based on the conductivity, the performance of the degasser can be measured in real-time and the performance optimized with regards to flow rates and volumes of purge air. Due to the enhanced ability to monitor efficiency a purge system is preferred over a vacuum system.

Because the purge gas pressure is lower in the microporous plate than the surrounding metallostatic pressure, the purge gas is retained in the micro-porous plate. The microporous plate is structurally designed such that the microporous material is not penetrated by the molten metal but is permeable with respect to the hydrogen cation in the molten metal.

The micro-porous plate microstructure and material are selected such that capillary penetration of the molten metal into the micro-porous material will not occur. Material factors that control capillary penetration are the molten surface energy ($\gamma_{is}$), the metal-material wetting angle ($\theta$), and the metallostatic head pressure ($H_p$). The critical metallostatic pressure ($H_p$) required to penetrate a micro-porous material is defined as:

$$H_p \geqq 4\gamma_{is}(\cos\theta)/g\rho\phi$$

wherein, Hp is the critical pressure for capillary penetration, $\gamma_{is}$ is the interfacial surface energy between the porous media and the molten aluminum, $\theta$ is the contact wetting angle of molten aluminum on the porous media, g is Newton's constant, $\rho$ is the liquid metal density and $\phi$ is the pore opening size of the porous metal. Therefore, the calculated $H_p$ must be substantially higher than the actual capillary pressure at a given immersion depth.

By selecting a micro-porous material with appropriate $\gamma_{is}$ and $\theta$ values for a given molten metal immersion depth to maintain a sufficiently high $H_p$, the micro-porous plate will resist capillary penetration of the molten metal yet will remain permeable to both the hydrogen gas and the purge gas required to remove the hydrogen gas.

A wide range of porous material would be suitable for demonstration of the present invention within the context of permeability, as set forth previously, and the understood desire to have a non-reactive material.

Particularly preferred materials include rigidized vacuum formed fiber boards, open cell reticulated ceramic foam, ceramic foam with micro-porous coating, bonded particle materials and ceramic materials where an organic pore former material, such as walnut flour, organic microspheres, saw dust or the like is added to the slurry and is burned out during firing.

Rigidized vacuum formed fiber boards are materials based on aluminum silicate, silica, magnesium silicate or alumina fibers typically bonded with either colloidal silica or alumina. The fiber microstructure is extremely fine and open with 60-70% open pore volume. These materials have excellent thermal shock resistance due to their discontinuous fiber matrix. Vacuum formed fiber boards have low thermal diffusivity and therefore do not chill, or freeze, the molten aluminum on initial contact. Commercial rigidized vacuum formed boards are available commercially form either Zircar Ceramics Inc. of Florida, N.Y. or Rath Performance Fibers of Wilmington Del.

Open cell reticulated ceramic foams are completely open cell with a discontinuous structure. To prevent metal penetration a relatively fine pore size, preferably greater than 60 pores per inch, would be necessary unless coatings were incorporated to form a micro-porous coating.

Figure 4:
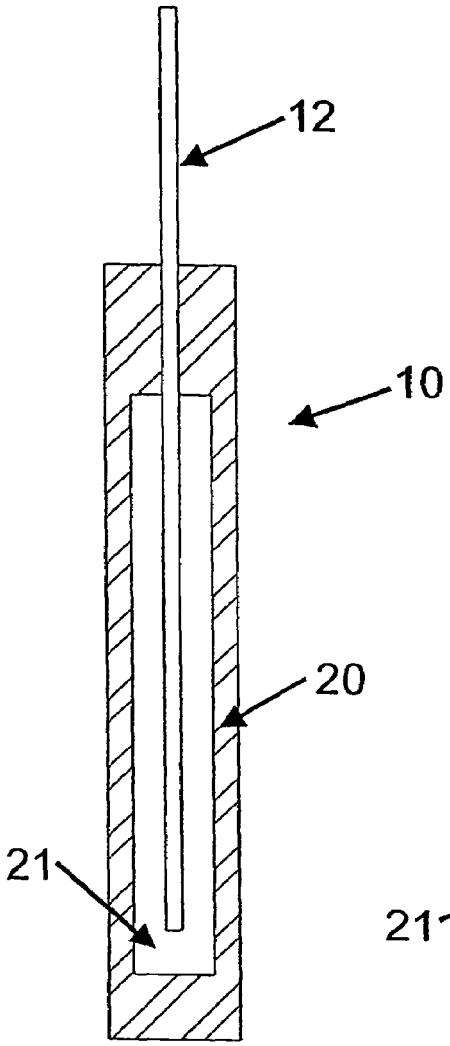
FIG. 4 is a cross-sectional side view of the degasser plate of FIG. 3.
Figure 3:
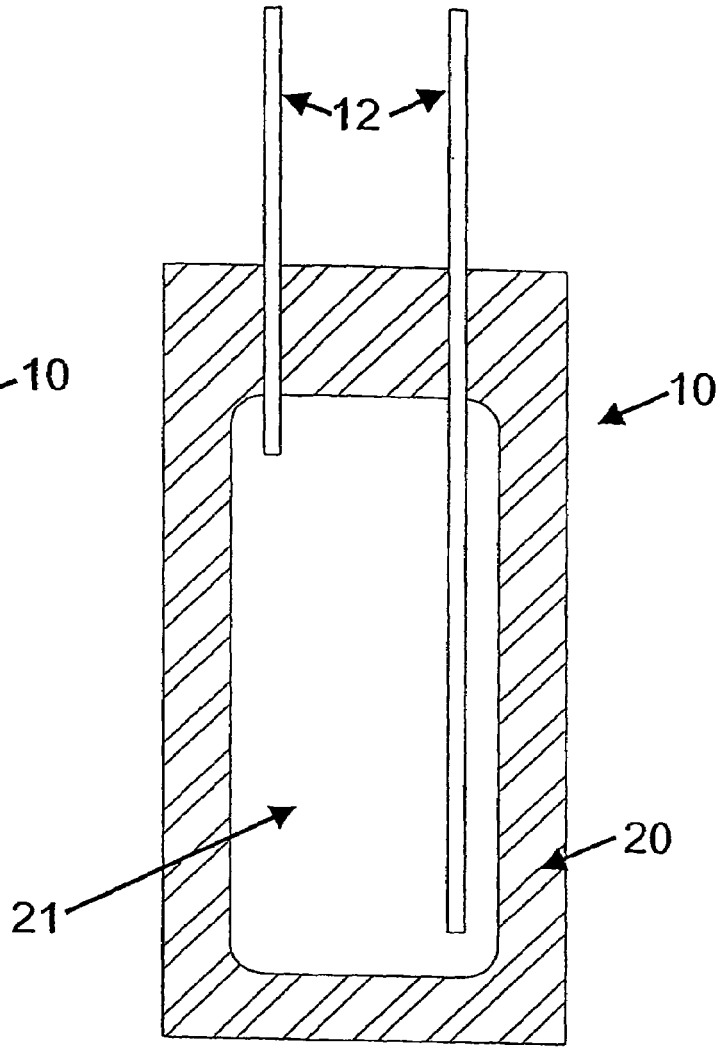
FIG. 3 is a front cross-sectional view of a degasser plate of the present invention.

An alternative embodiment is illustrated in front cross-sectional view in FIG. 3. A side cross-sectional view is provided in FIG. 4. The degasser of FIGS. 3 and 4, comprises a hollow, micro-porous plate, 20, with at least one interface tube, 12, in flow communication with a cavity, 21, interior to the plate. A particular advantage of the embodiment of FIGS. 3 and 4 is the elimination in pressure drop caused by the purge gas being forced to migrate through the porous material.

Figure 5:
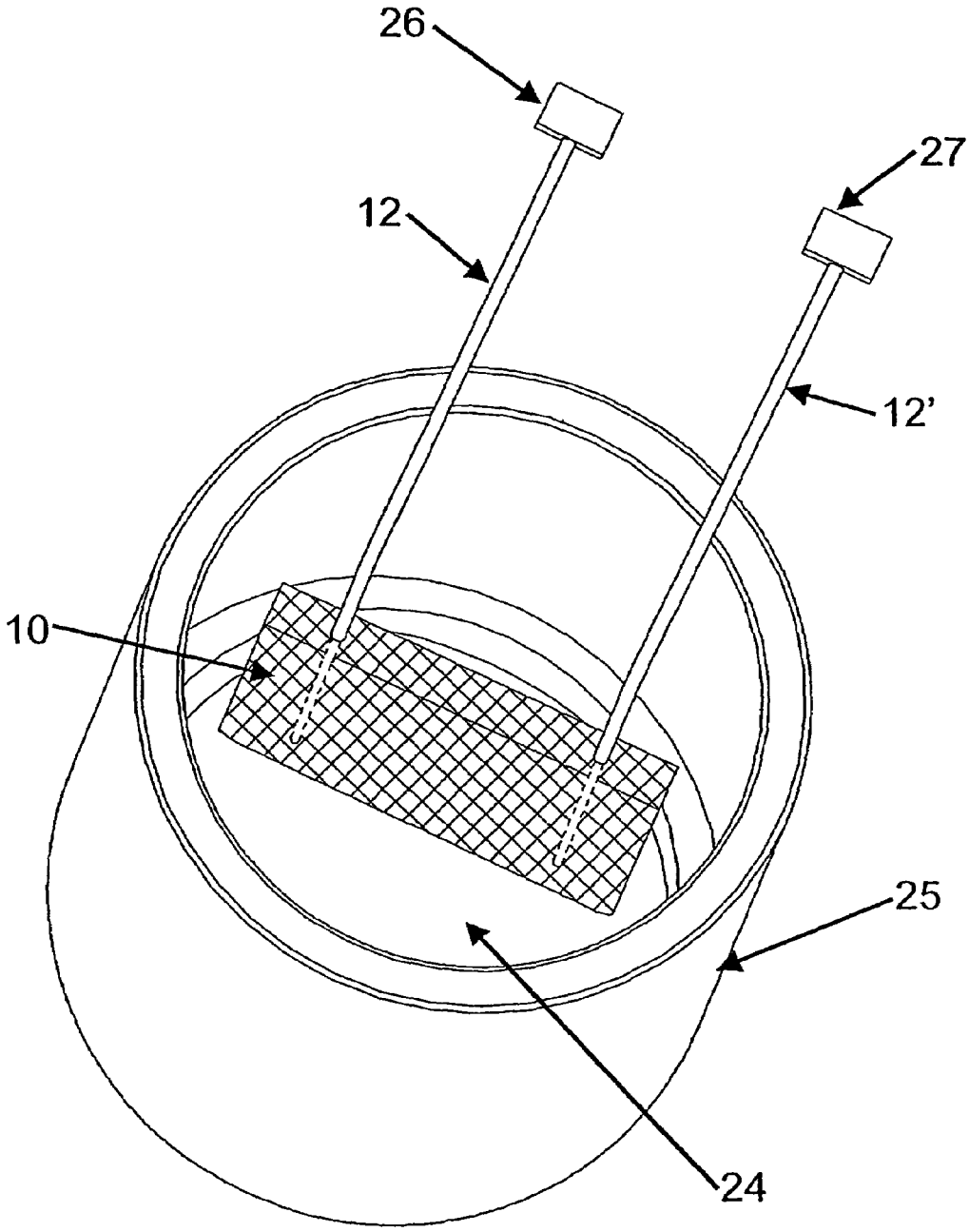
FIG. 5 is a perspective schematic view of a degasser plate of the present invention as visualized during use.

It is preferred that the micro-porous plate be submerged entirely below the surface of the molten metal to avoid creation of a flow path to ambient atmosphere. A top perspective schematic view of a degasser of the present invention as employed is provided in FIG. 5. In FIG. 5, the degasser, 10, comprising a pair of interface tubes, 12 and 12', is submerged in molten metal, 24, in a crucible, 25. Purge gas is provided by a source, 26, to the interface tube, 12, and exhausted from interface tube, 12', with hydrogen gas included therein. An auxiliary unit, 27, such as a vacuum pump or thermal conductivity analyzer is in flow communication with the exhaust interface tube, 12'.

Figure 6:
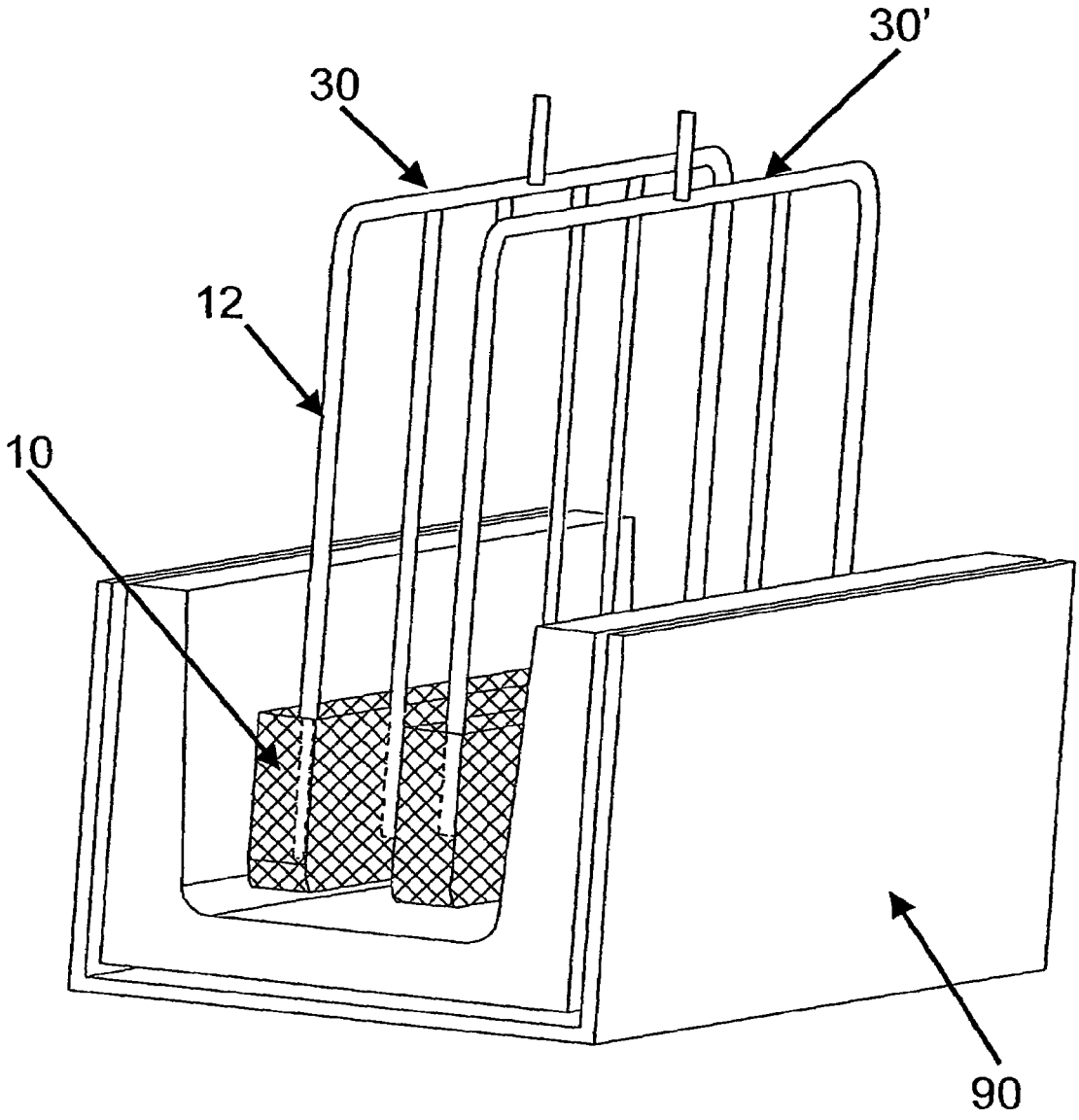
FIG. 6 is a schematic view of an embodiment of the present invention as employed in a casting launder.

In a continuous casting process the micro-porous plates could be installed in a wide range of locations depending on the specifics of the casting operation. In the case of billet or ingot casting the micro-porous plates could be installed in a casting launder as illustrated in FIG. 6 wherein the launder may be before or after the filter bowl. In the embodiment illustrated in FIG. 6, a multiplicity of degassers, 10, each with an inlet interface tube, 12, and exhaust interface tube, 12' are employed in a casting launder, 90. The multiplicity of inlet interface tubes, 12, are in flow communication with a gas manifold, 30, for supply of non-reactive gas to the degassers. Similarly, the multiplicity of exhaust interface tubes, 12', are in flow communication with an exhaust manifold, 30'. It would be understood that each degasser may have a unique gas supply and exhaust and that different degassers may have different arrangements. For example, in a multiple degasser arrangement, some degassers may employ a purge mechanism while others may employ a vacuum mechanism.

Figure 7:
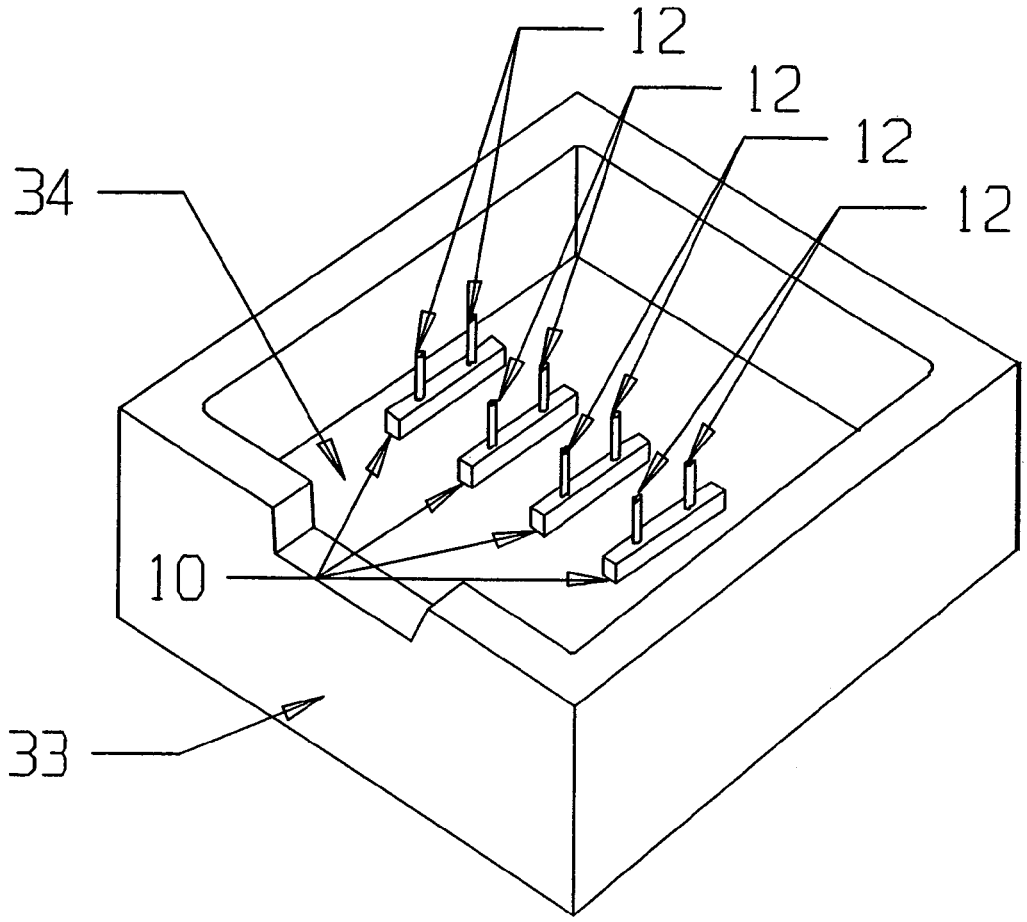
FIG. 7 is a top view of an embodiment of the present invention as employed in a filter bowl.

The degasser may be employed in the filter bowl as illustrated in FIG. 7, wherein the degasser, 10, and interface tubes, 12, are as described previously, and the filter bowl is indicated at 33. The filter, 34, is preferably a porous ceramic filter.

In continuous strip casting the porous plates could be installed in the casting launders, filter bowl, head box or embedded within the casting tip.

Figure 8:
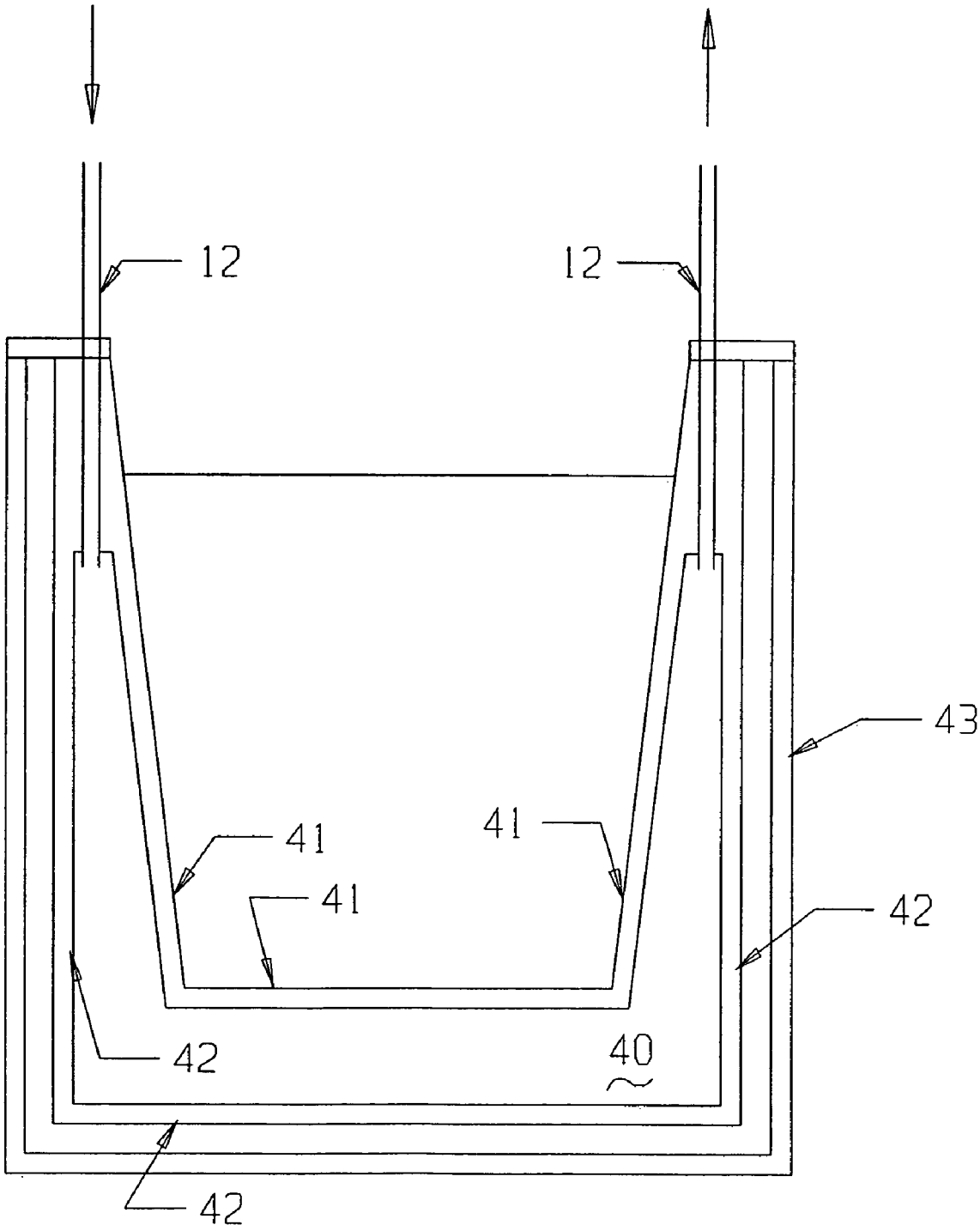
FIG. 8 is a cross-sectional schematic view of an embodiment of the present invention.

The degasser may be integral to the launder as illustrated in FIG. 8. In FIG. 8, the interface tubes, 12, are in flow communication with a cavity, 40. The interior walls, 41, are porous as set forth previously. The exterior walls, 42, are preferably non-porous or, alternatively, the exterior shell, 43, prohibits purge gas from exiting the localized environment of the launder.

Figure 9:
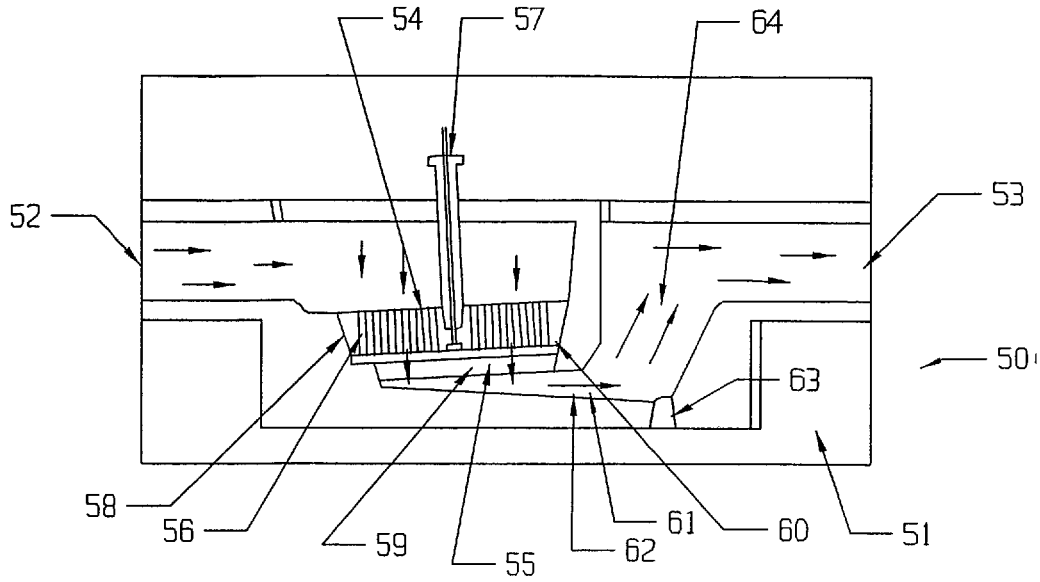
FIG. 9 is a cross-sectional view of an embodiment of the present invention.

A preferred embodiment of the present invention will be described with reference to FIG. 9. In FIG. 9, the micro-porous plate degasser, generally represented at 50, comprises a refractory containment vessel, 51, comprising an inlet throat, 52, and outlet throat, 53. The inlet throat receives molten metal and directs it through the vessel towards the outlet throat and to a reconnecting launder, or subsequent device, which is not shown.

Between the inlet throat and outlet throat is a degasser plate, 54, and optional filter, 55. The molten metal preferably passes through the degasser plate for degassing, as described previously, followed by flowing through the filter wherein insoluble materials are removed. In other embodiments the degasser can be downstream of the filter and in retrofit applications this may be preferred due to immutable restraints such as space, cost, overall layout etc. The filter can be removed, or not incorporated, when filtration is not required or is accomplished separately.

The degasser, 54, comprises a degasser plate, 56, and an associated interface tube, 57, located in a recess, 58. The recess is preferably tapered, wherein a substantial portion of the molten metal must go through, not around, the degasser plate, 56. A vacuum is drawn through the interface tube, 57, as described previously. Alternatively, a second interface tube, and purge gas, may be employed as previously described.

The filter is preferably separated from the degasser, 54, by an equalization space, 60, to allow the degassed molten metal to spread over the surface of the filter element to improve filtration efficiency. The equalization space is preferably at least about 6 mm to about 55 mm. Below about 6 mm the separation is insufficient to insure adequate spread of the molten metal over the surface of the filter. Above about 55 mm the advantages diminish resulting in an increased size of the entire system which is not desirable.

After passing through the degasser plate and filter, in either order, the molten metal enters a first transition region, 61, comprising a downward sloped floor, 62, and a drain plug, 63, at the lowest extent of the floor. The drain plug, 63, can be removed to drain the entire apparatus. After the first transition region the molten metal enters a second transition section, 64, which connects the degasser assembly to a downstream apparatus such as a transition launder, mold, transport assembly or the like. The second transition section is preferably oriented such that any non-forced flow would be towards the drain plug to facilitate draining of the degasser assembly. The first transition section and second transition section, taken together, represent the outlet throat, 53. It is preferred that the degasser assembly be drained between casts. When molten metal is not drained between casts it would be realized by those of skill in the art that an external heater is desired to maintain the stagnant metal in a molten state.

The orientation of the degasser plate is preferably horizontal, relative to ground, with molten metal flowing down through the plate. This orientation insures that the molten metal flows over the entire surface and therefore maximizes efficiency. The degasser assembly, and plate, may be in any orientation and molten metal may flow upward in a forced flow orientation if desired.

The filter may comprise multiple filter plates with the multiple plates having the same or different porosity. When multiple filter plates are employed it is preferred that they be separated to allow the molten metal to spread evenly over the face of the second filter. Multi-plate configurations are described in U.S. Pat. No. 5,673,902.

Figure 10:
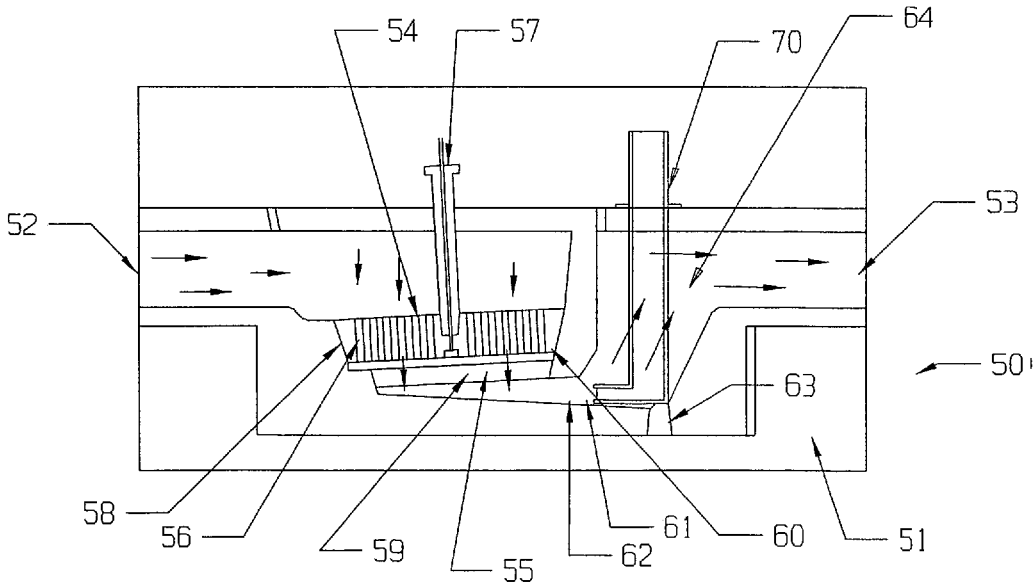
FIG. 10 is a cross-sectional view of an embodiment of the present invention being heated prior to use.

Prior to passing molten metal through the degasser assembly it is preferable to preheat the filter, degasser and containment vessel to prohibit localize solidification of molten metal as it contacts a cooler surface. A preheater is preferably inserted into the outlet throat, as illustrated in FIG. 10. In FIG. 10, the heater, 70, is inserted into the outlet throat, 53, and heat is directed in a counterflow direction, relative to metal flow, to heat the interior walls of the containment vessel as well as the filter and degasser.

Figure 11:
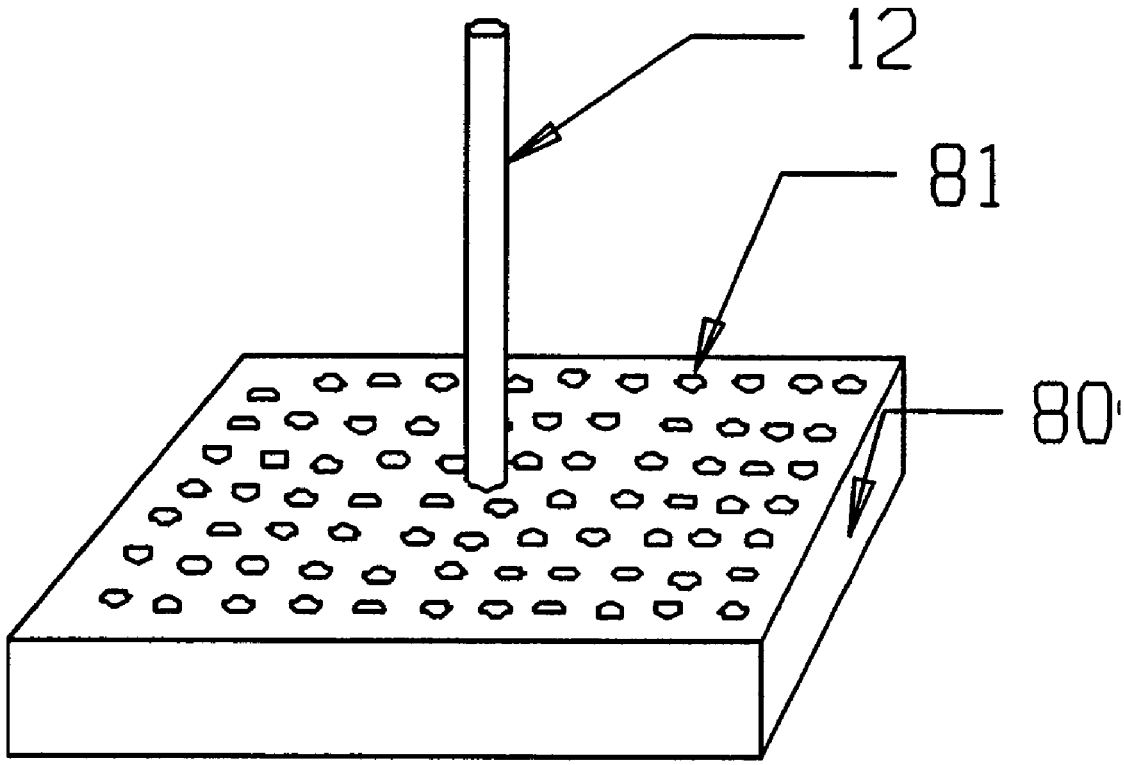
FIG. 11 is a perspective view of a preferred embodiment of the present invention.

A particular preferred degasser plate is illustrated in FIG. 11. In FIG. 11, the degasser plate, 80, comprises a multiplicity of passages, 81, through the plate. While not limited to any theory, the passages allow molten metal to pass through thereby reducing the diffusion path length for the dissolved hydrogen to reach the removal interface and increasing the contact surface area for hydrogen removal.

The passages have an equivalent diameter of at least about 500 microns to no larger than about 50 mm. More preferably, the passages have an equivalent diameter of 1 to 10 mm and more preferably about 5 to about 7.5 mm, Equivalent diameter is the diameter of a circle with the same cross-sectional area as the passage. Round passages are preferred due to manufacturing convenience The spacing between passages, measured from the center of each passage, is preferably about ½ to 10 times the hole diameter. Optimum hole spacing is about 3 mm to about 10 mm. The pattern of passages is preferably either simple orthogonal or close packed array with close packed array being preferred.

The degasser plate thickness can range from about 3 mm to about 200 mm. If passages are employed the plate can be thicker than if passages are not employed. A plate thickness of about 25-100 mm is most preferred for standard operations.

The preheater is preferably a medium velocity burner with excess air capability. Burners using above 100%, excess air, are preferred and the degasser assembly and filter assembly are heated by convective heat transfer.

The present invention has been described with particular reference to the preferred embodiments which are intended to illustrative but are not to be considered limiting. Other configurations, alterations and embodiments could be realized from the teachings herein without departing from the scope of the invention which is set forth more clearly in the claims appended hereto.

The invention claimed is:

1. A degasser for molten metal comprising:

a microporous plate comprising at least one internal passageway and an interface tube capable of removing gas from said internal passageway attached to said microporous plate in flow communication with said internal passageway and further comprising a vacuum pump attached to said interface tube.

2. The degasser of claim 1 further comprising a second interface tube in flow communication with a second internal passageway.

3. The degasser of claim 2 wherein said second internal passageway and said internal passageway form a cavity.

4. The degasser of claim 1 wherein said passageway comprises passages with an equivalent diameter of at least about 500 microns to no larger than about 50 mm.

5. A degasser for molten metal comprising:

a microporous plate comprising at least one internal passageway and an interface tube attached to said microporous plate in flow communication with said internal passageway wherein said passageway comprises passages wherein said passages have an equivalent diameter of at least about 5 mm to no more than about 7.5 mm.

6. A degasser for molten metal comprising: a microporous plate comprising at least one internal passageway and an interface tube attached to said microporous plate in flow communication with said internal passageway wherein said microporous plate comprises passages and wherein said passages are separated by a distance between about 0.5 to 10 times an equivalent diameter of said passage.

7. The degasser of claim 1 wherein said microporous plate is about 3 mm to about 200 mm thick.

8. The degasser of claim 1 further comprising a containment vessel with said microporous plate contained in said containment vessel.

9. The degasser of claim 8 further comprising a filter in said containment vessel.

10. The degasser of claim 1 further comprising a monitor in flow communication with said interface tube for monitoring gases flowing therethrough.

11. The degasser of claim 1 further comprising a purge arrangement attached to said interface tube.

12. The degasser of claim 2 further comprising a vacuum pump attached to said second interface tube.

13. The degasser of claim 2 further comprising a purge arrangement attached to said second interface tube.

14. The degasser of claim 5 further comprising a second interface tube in flow communication with a second internal passageway.

15. The degasser of claim 5 wherein said second internal passageway and said internal passageway form a cavity.

16. The degasser of claim 5 wherein said microporous plate is about 3 mm to about 200 mm thick.

17. The degasser of claim 5 further comprising a containment vessel with said microporous plate contained in said containment vessel.

18. The degasser of claim 17 further comprising a filter in said containment vessel.

19. The degasser of claim 5 further comprising a monitor in flow communication with said interface tube for monitoring gases flowing therethrough.

20. The degasser of claim 6 further comprising a second interface tube in flow communication with a second internal passageway.

21. The degasser of claim 6 wherein said second internal passageway and said internal passageway form a cavity.

22. The degasser of claim 6 wherein said passages have an equivalent diameter of at least about 500 microns to no larger than about 50 mm.

23. The degasser of claim 6 wherein said microporous plate is about 3 mm to about 200 mm thick.

24. The degasser of claim 6 further comprising a containment vessel with said microporous plate contained in said containment vessel.

25. The degasser of claim 24 further comprising a filter in said containment vessel.

26. The degasser of claim 6 further comprising a monitor in flow communication with said interface tube for monitoring gases flowing therethrough.

27. The degasser of claim 5 further comprising at least one of a vacuum pump attached or a purge arrangement attached to said interface tube.

28. The degasser of claim 6 further comprising at least one of a vacuum pump attached or a purge arrangement attached to said interface tube.

* * * * *